United States Patent [19]

Humphreys et al.

[11] Patent Number: 4,513,574

[45] Date of Patent: Apr. 30, 1985

[54] LOW TEMPERATURE AIR CONDITIONING SYSTEM AND METHOD

[75] Inventors: Norman G. Humphreys, Kansas City, Mo.; Raymond H. Dean, Shawnee Mission, Kans.

[73] Assignee: Tempmaster Corporation, North Kansas City, Mo.

[21] Appl. No.: 605,272

[22] Filed: Apr. 30, 1984

[51] Int. Cl.[3] ..... F24F 13/00; F24F 7/00

[52] U.S. Cl. ..... 62/59; 98/34.6; 236/49

[58] Field of Search ..... 236/49; 98/33 R, 38 F; 165/16; 62/59

[56] References Cited

U.S. PATENT DOCUMENTS 3,669,349 6/1972 Hall, Jr. ..... 236/49 X 3,929,285 12/1975 Daugherty, Jr. ..... 98/38 F

*Primary Examiner*—William E. Wayne

*Attorney, Agent, or Firm*—Kokjer, Kircher, Bradley, Wharton, Bowman & Johnson

[57] ABSTRACT

A low temperature air conditioning system provides primary air through smaller than normal ductwork and at a lower than normal temperature (such as 40° F.) at peak load conditions. The primary air is mixed in branch ducts with return air taken from the conditioned space. Low pressure fans pull the return air into mixing boxes equipped with dampers which maintain the downstream temperature in the branch ducts at a normal supply air temperature (such as 55° F.). Variable air volume terminal units discharge the air into the conditioned space. The small fans require only low horsepower and allow a smaller than normal central fan to be used. The cooling coil is cooled by a variable suction temperature refrigeration system which may be operated at night in conjunction with an ice storage system to minimize the demand for mechanical refrigeration during peak daytime hours. This arrangement permits the refrigeration machine to be smaller than normal and to consume less power during peak daytime hours.

6 Claims, 1 Drawing Figure

LOW TEMPERATURE AIR CONDITIONING SYSTEM AND METHOD

BACKGROUND OF THE INVENTION

This invention relates generally to the field of air conditioning and deals more particularly with a low temperature air conditioning system and method for use in relatively large commercial buildings.

The heating and cooling of large buildings such as multiple story office buildings is normally accomplished by circulating conditioned air through ventilating ducts that extend throughout the building. The air used to cool the building is usually supplied at about 55° F. In a variable air volume system, either the ducts or the air diffusers which discharge the conditioned air into the rooms of the building are equipped with flow control devices which permit the flow of conditioned air into each room to be individually controlled. In this manner, each room can be independently controlled as to its temperature and, at the same time, operating efficiencies and low costs are achieved due to the use of a single air handling unit to supply a number of different areas or floors of the building.

Despite the recognized advantages of variable volume systems, they are not wholly without problems. Because the conditioned air is normally supplied at about 55° F., it is necessary to provide relatively large ducts in order to adequately deliver the conditioned air throughout the building. The need for a large central air shaft and large ventilating ducts reduces the amount of useful space available in the building for rent or other purposes. It is also necessary for the central fan to pressurize the entire duct system and also handle all of the apparatus loss (due to the presence of filters, coils, sound absorbers, mixing dampers and other obstructions in the ductwork). The fan of a conventional variable air volume system in a typical office building must develop a pressure of about 5–6 inches W.G. Therefore, the fan motor must have considerable horsepower capacity which significantly adds to both the initial cost and to the ongoing operating costs. The need for a relatively large cooling coil further contributes to the initial cost of the air conditioning equipment.

Another type of air distribution system known as a high pressure induction system has long been used in office towers. The induction systems circulate colder air and moderate the air temperature in the ducts by adding return air taken from the conditioned space. However, it is impractical in the induction system to have a pressure of more than about 0.3 inch W.G. in the secondary air path or downstream from the point where the cold primary air and the secondary air are mixed, because the induction process degrades rapidly with increasing pressure. This low secondary air or downstream pressure is a practical limitation which makes it impossible to use variable volume terminal units in an induction system because the downstream pressure is too low to drive air through the terminal.

The use of fans to mix secondary return air with varying volume primary air is also known. However, the fan powered boxes that are capable of use in variable volume systems must fit above the ceiling in a commercial building, and fans of this type have not been able to develop enough pressure to adequately drive the conditioned air through a variable volume terminal unit. Consequently, it has not been practical to use variable volume terminals downstream of fan powered boxes.

SUMMARY OF THE INVENTION

The present invention is directed to an air conditioning system which achieves both a low initial cost and a low operating cost while taking full advantage of the benefits of variable air volume. In our new system, primary air that is colder than normal (40° F. rather than 55° F.) is circulated through relatively small supply ducts by a medium pressure central fan having about 60% of the capacity and power requirements of the fans used in conventional variable volume systems. The cooling coil is likewise only about 60% as large as normal. The low temperature primary air is mixed with warmer ceiling plenum return air in fan powered boxes which include low pressure "furnace fans". The relative amounts of cold and warm air that are mixed are controlled to maintain the downstream air at a normal 55° F. temperature for distribution through low pressure ductwork. Low pressure variable volume terminal units discharge the air into the conditioned space to create individual comfort zones.

In comparison to conventional variable volume air conditioning systems, the system of the present invention has smaller ductwork, reduced fan requirements, increased operating efficiency and a smaller cooling coil. The smaller ductwork results in lower initial costs and more space available in the building for rent and other productive purposes. The ability to use a smaller central fan creates cost savings both in equipment and energy consumption. Additionally, the normal cost and operating advantages of a variable volume system are achieved, along with the benefit of individual temperature control of each room or other space in the building.

Only 60% of the total air requirement is supplied by the central fan at the relatively high primary supply pressure. The balance of the air is supplied by the smaller fans which operate at only about 0.5–0.75 inch W.G. The overall result is a significant reduction in the horsepower requirements because 40% of the air is supplied at such a low pressure.

The refrigeration system which cools the air can employ, for example, screw compressors with provision for varying the suction temperature. A liquid-suction heat exchanger can be used to improve the efficiency and minimize superheating in the cooling coil while avoiding frost formation on the cooling coil at maximum load conditions. At light load conditions, the suction temperature can be raised to improve efficiency. At the same time, the primary air supply temperature is raised and when it reaches 55° F. or above, the small fans are turned off and the dampers in the mixing boxes are fully opened. Thus, extremely efficient operation is achieved in mild weather.

Additional economies are possible by using outside air in cool weather, by cooling at night to precool the building mass when electricity rates are reduced, and by judiciously using an ice storage system as the final storage medium. The refrigeration machine can be reduced in size and operated at night in hot weather to precool building slabs and make ice in an ice storage tank when the building is virtually unoccupied and the lights are off. When the cooling demand increases during the day, the precooling of the building mass delays the need for peak mechanical cooling and thus reduces the necessary ice storage capacity to approximately one half the normally expected value. When additional cooling is required, cold water or slush can be circulated between the ice storage tank and a secondary cooling coil in the air conditioning system to provide the necessary peak cooling in the afternoon. The storage in the building mass and the ice tank together compensate for the undersized compressor when the demand peaks and the power rates are highest. The overall energy cost requirements are reduced by the reduced fan energy requirements and the use of building thermal storage and/or ice storage to avoid high peak demand charges such as occur in conventional systems when a large compressor operates at maximum load.

DETAILED DESCRIPTION OF THE INVENTION

Figure 1:
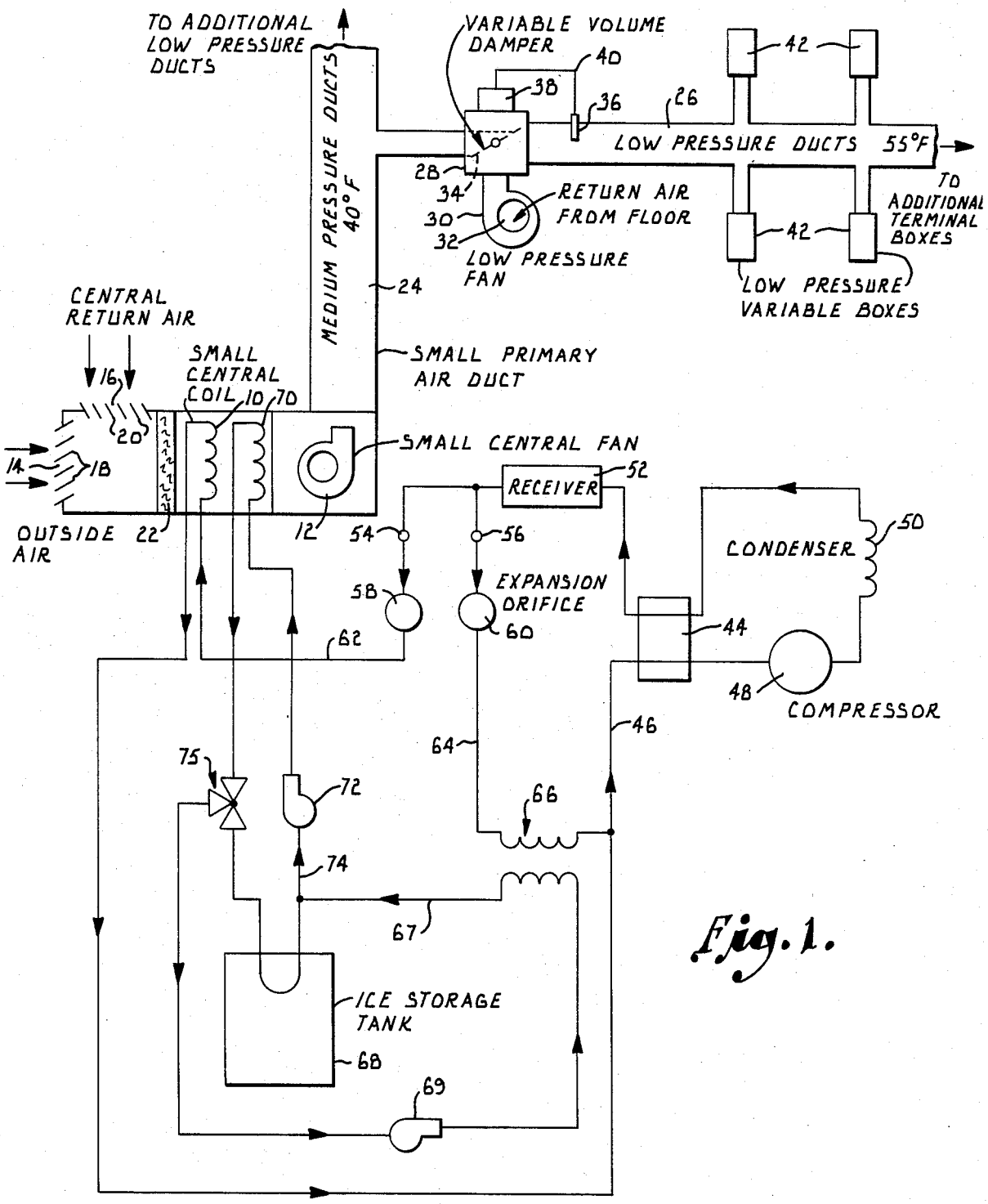

In the accompanying drawing which forms a part of the specification and is to be read in conjunction therewith and in which like reference numerals are used to indicate like parts in the various views:

FIG. 1 is a schematic diagram of a low temperature air conditioning system arranged according to a preferred embodiment of the present invention.

The present invention is directed to an air conditioning system for cooling large commercial buildings such as office buildings. The air handling unit of the air conditioning system includes a finned cooling coil 10 and a central fan 12 which draws air past the cooling coil 10 and circulates the conditioned air through the area of the building served by the system. The air which is drawn into the intake side of the fan 12 can be either outside air entering through an inlet 14 or return air from the conditioned space entering through an inlet 16 which connects with a return duct (not shown). The inlets 14 and 16 are controlled by dampers 18 and 20, respectively which can be opened and closed as desired to control the amount of outside air and return air that is circulated by the fan. An air filter 22 is disposed between the cooling coil 10 and the inlets 14 and 16.

The output side of the central fan 12 connects with a primary air duct 24 which extends within the building. A plurality of branch ducts, one of which is designated by numeral 26, connect with the primary duct 24 at various locations along the length of the primary duct. Each of the branch ducts 26 serves a particular area within the building.

The primary conditioned air supplied by the central fan is colder than normal and may be approximately 40° F. rather than the more usual 55° F. air supplied by conventional systems. The cool primary air is circulated by fan 12 through the primary duct 24 and into each of the branch ducts 26. In each branch duct, the cool primary air is mixed with return air from the conditioned space served by the branch duct. The mixing of the primary and return air is accomplished in each branch duct 26 in a fan powered mixing box 28. Each box 28 is disposed in the low pressure branch duct 26 slightly downstream from the connection between the branch duct and the primary duct 24. Each mixing box 28 is equipped with a low pressure "furnace fan" 30 having its intake 32 communicating with the conditioned space served by the branch duct 26. The output side of the fan connects with the mixing box 28 in order to provide return air for mixing with the cold primary air supplied by the primary air duct 24.

Each mixing box 28 is equipped with a variable volume damper 34 which controls the flow of primary air through duct 26. Each damper is controlled by a temperature sensor 36 which senses the temperature of the air immediately downstream of the mixing box 28. Each fan powered box 28 can be set to maintain a constant preselected air temperature downstream from the mixing box. For example, if the temperature is set at 55° F., the damper 34 is controlled to mix sufficient primary air with the warm return air to achieve a downstream air temperature of 55° F. at the temperature sensor 36. If the temperature sensed by the sensor is below 55° F. (or another set temperature), then the damper 34 is closed more fully in order to provide less cold primary air for mixing with the warm return air. Conversely, if the downstream temperature is above the set temperature, damper 34 is moved toward the open position to increase the amount of cold primary air. Each damper 34 is operated by an actuator 38 through a control line 40 extending to the actuator from the temperature sensor 36. Each branch duct may have a heating coil (not shown) downstream from the mixing box 28.

The mixing boxes 28 can be conventional, commercially available boxes (preferably provided with extra insulation) equipped with a relay for controlling the fan and a simple actuator for controlling the damper 34. The actuator can be driven by a discharge thermostat on design days. Under conditions of light loading (when the primary air temperature is 55° F. or greater), the fan is shut off and the damper is fully opened.

Alternatively, overall system costs can be reduced by simplifying the controls (using simple floating controls) and equipping each mixing box with a pressure controller. At design load, the pressure controller modulates the discharge damper on the fan 32 of the mixing box. Under light loading when the fan is off and the return air is zero, the pressure controller switches to the primary air damper 34 and acts as a high limit.

Each low pressure branch duct 26 is equipped with a plurality of spaced apart variable volume terminal units 42 which discharge the conditioned air into the space served by the branch duct. The terminal units 42 are spaced apart from one another, and each terminal unit 42 can be individually adjusted to vary the volume rate of air that is discharged into the space through the terminal unit. Preferably, each terminal unit is a variable volume air diffuser of the type shown in U.S. Pat. No. 4,331,291 to Raymond H. Dean, which is incorporated herein by reference. The effective size of the diffuser outlet slot can be varied to control the flow rate. Since the volume rate of flow through each terminal 42 can be independently varied, the area served by each terminal is an individual comfort zone which can be controlled in temperature to suit the individual preference of the occupant or occupants.

Approximately 40% of the total air requirement of the air conditioning system is supplied by the low pressure furnace fans 30, and the remaining 60% is supplied by the central fan 12. Since the central fan 12 is not required to supply all of the air that is eventually delivered to the conditioned space, the horsepower requirements of the fan 12 are significantly reduced and result in reduced fan energy consumption compared to conventional variable air volume systems.

At the same time, the primary air supplied by the cooling coil 10 is significantly colder than normal (40° F. instead of 55° F.). As a result, the size of the duct 24 can be reduced considerably in comparison to conventional systems which supply air at 55° F. The cooling coil 10 also can be reduced in its surface area (by about 40%).

The low pressure fans 30 operate at 0.5–0.75 inch W.G., which is all the pressure necessary to adequately drive the conditioned air through the variable volume air terminals 42. Because of the low pressure requirements downstream from the mixing boxes 28 in the low pressure ducts 26, the energy requirements for the fans 30 are low. Since only about 60% of the air must be supplied at the relatively high primary air pressure and the remaining 40% is supplied at a much lower pressure (0.5–0.75 inch W.G.), the overall fan requirements are reduced significantly compared to conventional variable volume air conditioning systems.

For example, a conventional system having a 100,000 cfm air requirement at 5 inches W.G. pressure has a peak power requirement of about 500 KW. To provide a margin, the fan would have about 550 KW capacity. In our system, the same air requirements would call for a central fan capable of providing 60,000 cfm at 5 inches W.G. (300 KW) and low pressure fans capable of providing the remaining 40,000 cfm at 0.75 inch W.G. (30 KW), for a total of 330 KW or about 365 KW to provide a margin.

As previously indicated, the primary air is supplied at approximately 40° F., and the evaporator cooling coil 10 is thus relatively cold (near 32° F.). In order to prevent frost from developing on the cooling coil, the refrigeration system may be a variable suction temperature machine which includes a liquid-suction heat exchanger 44 which minimizes the need for superheating in the coil itself.

The heat exchanger 44 is located in the suction line 46 of a compressor 48 which is preferably a relatively wide pressure ranging device such as a screw compressor. The suction line 46 extends from connection with the vapor side of the cooling coil 10. The discharge side of compressor 48 connects with a condenser coil 50 from which the condensed liquid refrigerant flows through the liquid-suction heat exchanger 44 and then into a receiver 52. The heat exchanger 44 serves to sub cool the liquid from the condenser while simultaneously superheating the vapor on the suction space of the compressor.

Arranged in parallel with one another on the downstream side of receiver 52 are a pair of solenoid valves 54 and 56 which, when open, direct the liquid refrigerant through respective expansion orifices 58 and 60. Orifice 58 supplies refrigerant directly to coil 10 through line 62. The other orifice 60 connects with a line 64 which includes a heat exchange coil 66 coupled to an ice storage tank 68 through water line 67. The coil 66 connects on its opposite side with the common suction line 46. When the refrigerant circulated through coil 66 is below 32° F. and pump 69 is on, the water contained in the ice storage tank 68 is frozen to produce ice. When the pump 69 is off, the heat exchanger 66 is thermally isolated from the storage tank 68, thus avoiding under refrigerant migration during daytime operation when suction temperatures are high.

Supplemental cooling is provided by a secondary cooling coil 70 located immediately downstream from the primary cooling coil 10 in the path of air drawn into the suction side of the central fan 12. A water or slush pump 72 pumps water or slush through a water line 74 which supplies the supplemental cooling coil 70 and which also passes through the ice storage tank 68 to cool the water or slush which is circulated by pump 72 through line 74, coil 70 and back through the tank 68. Pump 72 operates to provide extra cooling at the end of the operating periods. The 3-way valve 75 is required only if there is significant pressure drop for the circulating fluid as it moves through the ice storage tank.

If there is no provision for ice storage, when the refrigeration machine is operating normally, valve 54 is open, and the cooling coil 10 cools the conditioned air to approximately 40° F. If ice storage is used, coil 10 only cools the air to approximately 55° F., and the remaining (peak) cooling is provided by coil 70 which receives ice water cooled by the ice in tank 68 and circulated through the tank and coil 70 by pump 72. The central fan 12 operates at a pressure (normally about 5 inches W.G.) sufficient to distribute the conditioned primary air through the primary duct 24 and to the mixing boxes 28 in the low pressure branch ducts 26. The low pressure furnace fans 30 operate at about 0.5–0.75 inch W.G. to provide sufficient pressure downstream in the branch ducts 26 to drive the conditioned 55° F. air through the variable volume terminal units 42.

By controlling the compressor loading, efficiencies can be achieved by raising the cold refrigerant temperature at times when the cooling load is light, such as on spring and fall days. When ice storage is used, the cold refrigerant temperature is always high during daytime hours, even on peak loading summer days. In addition to improving efficiency, this method of operation minimizes first cost by avoiding the need to increase compressor size to accomodate the low-temperature ice-making function. When the primary air temperature exceeds a prescribed set point approximately equal to the typical set point of temperature sensor 36, the furnace fans 30 on the mixing boxes 28 are turned off and the actuators 38 drive dampers 34 toward the open position. The central fan 12 then supplies conditioned air at a more normal temperature of approximately 55° F. and ice storage is not used for cooling, even if available. Due to the small cooling load, the system can operate in the manner of a conventional variable volume system by providing 55° F. air from the central fan 12. When the outside air drops below 55° F., the outside louvers 18 can be fully opened to use free outside air for cooling.

The central fan 12 frequently operates near its peak capacity where its efficiency is highest from an operating cost standpoint. The modulation of air quantity required by the system is aided in the manner previously described by cycling the low pressure fans 30 or riding the fan curves in the air mixing boxes 28 when the fans 30 are on. Inlet vanes on the central fan 12 begin to close only at light loading.

In hot weather, the system is set to provide 40° F. primary air. At night, this cool primary air can be used with variable air volume terminals discharging above the ceilings in the building to precool the building slabs before occupancy in the morning, thereby providing thermal storage in the building mass. This has the advantage of operating the refrigeration machine at night when the demand for power is low and the electric utility rates are low.

Additionally or alternatively, the refrigeration system can be operated at night with refrigerant suction temperature below freezing. By closing valve 54 and opening valve 56, all of the refrigerant is directed through the heat exchange coil 66 which is coupled to the ice storage tank 68 by water line 67. Ice is thereby produced in the ice storage tank for later use in cooling when the cooling demand is high and the electricity rates are likewise high. If ice storage is provided, the refrigeration system is operated in the day time with a conventional (high) suction temperature. When valve 56 is closed and valve 54 is open, all of the refrigerant is directed to the primary cooling coil 10. Initially, the cold building mass provides most of the cooling, and the central fan and compressor are unloaded. As time progresses, both become loaded more heavily. When the effect of precooling the building mass has dissipated (which may be near mid day) and there is a high demand for cooling, pump 72 is turned on to pump ice water through tank 68 and coil 70, thereby assisting in providing the cooling required by the building. This has the advantage of permitting the use of a relatively small compressor and thus reducing the electrical demand.

It is thus apparent that the low temperature air conditioning system of the present invention has reduced space requirements for ductwork and enjoys a relatively low first cost due to the small size of the ductwork, the central fan 12 and the cooling coil 10. At the same time, the operating efficiency of the system is increased because of the low fan energy usage. Moreover, thermal storage in the building and in the ice storage tank 68 can be used to reduce use of the compressor during times of peak demand charges.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawing is to be interpreted as illustrative and not in a limiting sense.

Having thus described the invention, we claim:

1. In a system for distributing conditioned air in a building at a preselected temperature, the combination of:

a primary air distribution duct extending in the building;

a primary cooling coil for cooling air to a low temperature below said preselected temperature;

a secondary cooling coil;

a refrigeration system for cooling said primary coil, said refrigeration system including a compressor having a suction side and a discharge side and a condenser connected with the discharge side of said compressor for condensing refrigerant compressed by the compressor;

an ice storage tank for holding ice;

a heat exchanger arranged in parallel with said primary cooling coil to produce a fluid temperature at or below 32° F. when refrigerant is directed through said heat exchanger at a temperature below 32° F.;

valve means for directing refrigerant to said primary coiling coil or to said heat exchanger;

a fluid line passing through said heat exchanger and said ice storage tank;

pump means for pumping fluid through said fluid line;

a cold water line passing through said ice storage tank and said secondary cooling coil;

pump means for pumping water through said storage tank and secondary coil to cool the latter, whereby the refrigerant can be directed through said heat exchanger to produce ice during off peak times and the refrigerant can be directed to said primary cooling coil during peak times and said secondary coil can receive cold water during peak times to provide supplemental cooling and to permit a higher temperature on the suction side of the compressor during peak times;

a central fan operable to force air past said primary cooling coil and said secondary cooling coil and through said primary duct at a preselected pressure level, thereby supplying conditioned air through the primary duct at said low temperature and said preselected pressure level;

a plurality of branch ducts each connected with said primary duct to receive the low temperature air therefrom, each branch duct serving a space in the building and extending to said space to deliver conditioned air thereto;

a low pressure fan for each branch duct having an inlet side receiving return air from the space served by the branch duct and a discharge side delivering the return air to the branch duct for mixing therein with the low temperature air, each low pressure fan delivering air downstream therefrom in the branch duct at a low pressure level below said preselected pressure level;

means in each branch duct for controlling the relative amounts of low temperature and return air mixed in the branch duct in a manner to maintain the air downstream from the low pressure fan substantially at said preselected temperature; and a plurality of variable volume outlets for each branch duct located downstream from the low pressure fan for discharging air at said preselected temperature to the space served by the branch duct, each outlet being individually variable to vary the volume rate of discharge of the air entering the space through the variable volume outlet.

2. In a low temperature air conditioning system having a cooling coil, the combination of:

a refrigeration system having a compressor for compressing refrigerant, a vapor line connecting said cooling coil with a suction side of the compressor, a condenser for condensing the refrigerant connected with a discharge side of the compressor, a receiver connected with said condenser on the downstream side thereof, expansion means for expanding the refrigerant between said receiver and said coil, and heat exchange means for exchanging heat between the vapor refrigerant approaching the suction side of said compressor and the liquid refrigerant passing between the compressor and said expansion means, thereby cooling the liquid refrigerant and superheating the vapor refrigerant;

an air distribution system having a primary air duct, a plurality of branch ducts extending from said primary duct and each serving a conditioned space, central fan means for forcing air past said cooling coil and into said primary duct at a primary air pressure to thereby supply low temperature air through the primary duct, low pressure fan means for forcing return air into each branch duct from the conditioned space served thereby to effect mixing of the return air with the low temperature air supplied to the branch duct by the primary duct, means for operating said low pressure fan means at a pressure substantially below the central fan means at a pressure substantially below the central fan means, means for controlling the relative amounts of return air and low temperature air mixed in each branch duct to maintain the air mixture in each branch duct at a preselected temperature above the temperature of the air in the primary duct, and a plurality of variable volume outlets in each branch duct for discharging conditioned air therefrom into the conditioned space served by the branch duct, each outlet being adjustable to vary the volume rate of air flow therethrough; and an ice storage system having an ice storage tank for holding ice, a heat exchanger located outside said tank and arranged in parallel with the cooling coil, valve means for directing the refrigerant to said cooling coil or to said heat exchanger for evaporation therein to produce cold air with said cooling coil or, ice in said tank, means for thermally isolating said heat exchanger from said tank when refrigerant is not directed to said heat exchanger, a secondary cooling coil located in the path of the air approaching said primary duct, a water line extending through said ice storage tank for cooling thereby and through said secondary cooling coil to cool same, and pump means for circulating water through said water line for cooling of said secondary coil, whereby the secondary coil provides supplemental cooling of the air approaching said primary duct.

3. A method of distributing conditioned air at a preselected temperature in a building having a primary duct and a plurality of branch ducts each serving a space in the building, said method comprising the steps of:

locating a cooling coil in the path of the air approaching said primary duct;

compressing refrigerant in the vapor phase;

passing the refrigerant through a condenser to effect condensing of the refrigerant;

expanding the refrigerant;

directing the expanded refrigerant through the cooling coil for evaporation therein to effect cooling of the coil;

exchanging heat between the vapor refrigerant from the cooling coil and the liquid refrigerant from the condenser to cool the liquid refrigerant and superheat the vapor refrigerant;

providing an ice storage tank;

locating a heat exchanger outside the tank;

providing a means of thermally coupling said heat exchanger to said storage tank and decoupling said heat exchanger from said storage tank when said heat exchanger is not in use;

directing the refrigerant through said heat exchanger but not through said cooling coil during a first time period of low demand for cooling to thereby produce ice in said tank during said first time period;

directing the refrigerant through said cooling coil but not through said heat exchanger during a second time period of high demand for cooling;

providing a second cooling coil in the path of the air approaching said primary duct;

pumping liquid through said ice storage tank for cooling therein and then through said second cooling coil during said second time period, whereby said second coil provides supplemental cooling during said second time period;

forcing air past said coils for cooling thereby to a low temperature below said preselected temperature and then into the primary duct at said low temperature and at a preselected pressure level;

directing the air from the primary duct into each of the branch ducts;

forcing return air from the space served by each branch duct into the branch duct at a preselected location to mix the return air with the low temperature air in the branch duct;

controlling the amounts of return air and low temperature air mixed in each branch duct in a manner to maintain the air downstream at said preselected temperature;

dellivering the air downstream from said preselected location in each branch duct at a pressure level below said preselected pressure level;

discharging the air from each branch duct into the space served thereby through a plurality of outlets; and individually adjusting the effective size of each outlet to vary the volume rate of discharge of conditioned air entering the space through each outlet.

4. The method of claim 3, wherein the refrigerant is maintained at a first temperature prior to said compressing step during said first time period and at a second temperature prior to said compressing step during said second time period, said second temperature being higher than said first temperature.

5. In a system for distributing conditioned air in a building at a preselected temperature, the combination of:

a primary air distribution duct extending in the building;

cooling means for cooling air to a low temperature below said preselected temperature;

a central fan operable to force air past said cooling means and through said primary duct at a preselected pressure level, thereby supplying conditioned air through the primary duct at said low temperature and said preselected pressure level;

a plurality of branch ducts each connected with said primary duct to receive the low temperature air therefrom, each branch duct serving a space in the building and extending to said space to deliver conditioned air thereto;

a low pressure fan for each branch duct having an inlet side receiving return air from the space served by the branch duct and a discharge side delivering the return air to the branch duct for mixing therein with the low temperature air, each low pressure fan delivering air downstream therefrom in the branch duct at a low pressure level in the range of approximately 0.5 inch W.G. to 0.75 inch W.G., said preselected pressure level being substantially greater than said low pressure level;

means in each branch duct for controlling the relative amounts of low temperature and return air mixed in the branch duct in a manner to maintain the air downstream from the low pressure fan substantially at said preselected temperature;

a plurality of variable volume terminals for each branch duct located downstream from the low pressure fan for discharging air at said preselected temperature to the space served by the branch duct; and system powered control means for each terminal for varying the volume rate of air flow therethrough, said control means for each terminal being operated by the pressure in the corresponding branch duct under the control of a thermostat in the space served by the terminal and each control means being independent of the other control means.

6. A method of distributing conditioned air at a preselected temperature in a building having a primary duct and a plurality of branch ducts each serving a space in the building, said method comprising the steps of:

cooling air to a low temperature below said preselected temperature;

forcing the cooled air into the primary duct at said low temperature and at a preselected pressure level;

directing the air from the primary duct into each of the branch ducts;

forcing return air from the space served by each branch duct into the branch duct at a preselected location to mix the return air with the low temperature air in the branch duct;

controlling the amounts of return air and low temperature air mixed in each branch duct in a manner to maintain the air downstream at said preselected temperature;

delivering the air downstream from said preselected location in each branch duct at a pressure level below said preselected pressure level in the range of approximately 0.5 inch W.G. to 0.75 inch W.G.;

discharging the air from each branch duct into the space served thereby through a plurality of outlets;

providing each outlet with a system powered flow control device operated by the pressure in the corresponding branch duct to vary the volume rate of discharge of conditioned air entering the space served by the outlet; and using a thermostat signal from the space served by each outlet to adjust the flow control device therefor in accordance with the thermostat signal.

* * * * *